US006457604B1

(12) United States Patent
McNabb

(10) Patent No.: US 6,457,604 B1
(45) Date of Patent: Oct. 1, 2002

(54) SPILL-PROOF HOLDER

(76) Inventor: Otho F. McNabb, 15731 Live Oak Rd., Chino Hills, CA (US) 91709

( * ) Notice: Subject to any disclaimer, the term of this patent is extended or adjusted under 35 U.S.C. 154(b) by 0 days.

(21) Appl. No.: 09/911,404

(22) Filed: Jul. 25, 2001

(51) Int. Cl.[7] ..... B65D 25/24
(52) U.S. Cl. ..... 220/737; 220/4.25; 215/395
(58) Field of Search ..... 220/4.21, 4.24, 220/4.25, 737, 739, 603; 215/395, 387, 386, 379, 370

(56) References Cited

U.S. PATENT DOCUMENTS

| | | | | |
|---|---|---|---|---|
| 497,878 A | | 5/1893 | Higham | |
| 2,150,835 A | | 3/1939 | Kazimirow | |
| 2,311,397 A | | 2/1943 | Kazimirow | |
| 2,341,092 A | * | 2/1944 | Gooden | 131/242 |
| 2,748,952 A | | 6/1956 | Fleit et al. | |
| 4,799,636 A | | 1/1989 | Johnson | |
| 5,938,058 A | | 8/1999 | Kim | |

FOREIGN PATENT DOCUMENTS

| | | | |
|---|---|---|---|
| FR | 1371240 A | * | 7/1964 |
| FR | 2315246 A | * | 1/1977 |
| GB | 1444873 | | 8/1976 |

* cited by examiner

*Primary Examiner*—Stephen Castellano
(74) *Attorney, Agent, or Firm*—Richard C Litman

(57) ABSTRACT

A bottle holder for holding a bottle in an upright position. Regardless of the position in which the holder is placed, it will roll itself into an upright position. The upper portion of the holder has a bottle keeper for snugly holding a bottle, allowing one to use the bottle without removing it from the holder. The bottom portion of the holder is weighted and is much heavier than the top portion. Because the bottom portion is weighted, it will remain on the bottom and a bottle in the holder will remain upright. A flat portion on the bottom portion provides a place for the holder to rest. Because of the weight differential between the bottom and top portions, no matter how the bottle holder is set down, it will rock back to an upright position such that it will rest on the flat portion of the bottom portion.

5 Claims, 4 Drawing Sheets

SPILL-PROOF HOLDER

BACKGROUND OF THE INVENTION

1. Field of the Invention

The present invention relates to a holder that is designed to hold a bottle in an upright position and rotate to an upright position regardless of how it is placed.

2. Description of the Related Art

U.S. Pat. No. 497,878, issued on May 23, 1893 to Howard Higham, U.S. Pat. No. 2,150,835, issued on Mar. 14, 1939 to Antonina Kazimirow, U.S. Pat. No. 2,311,397, issued on Feb. 16, 1943 to Antonina Kazimirow, U.S. Pat. No. 2,748,952, issued on Jun. 5, 1956 to Martin Fleit et al., and U.S. Pat. No. 4,799,636, issued on Jan. 24, 1989 to William Johnson, and English Patent No. 1,444,873, published on Aug. 4, 1976, teach bottle holders, some of which are spherical and/or position themselves automatically.

U.S. Pat. No. 5,938,058, issued on Aug. 17, 1999 to Cha Kim, teaches a segmented container.

None of the above inventions and patents, taken either singularly or in combination, is seen to describe the instant invention as claimed. Thus, a spill-proof holder solving the aforementioned problems is desired.

SUMMARY OF THE INVENTION

The present invention is a bottle holder for holding a bottle in an upright position. Regardless of the position in which the holder is placed, it will roll itself into an upright position. The upper portion of the holder has a bottle keeper for holding the bottle. The keeper includes a sidewall, sizing bars molded into the sidewall, and a floor.

The sizing bars hold the bottle in place in the bottle keeper. The sizing bars fit snugly around a bottle, allowing one to use the bottle without removing it from the holder. Because the bottles will conform to the sizing bars, bottles of different sizes can be held in place with the same holder.

The bottom portion of the holder is weighted, e.g. it houses a lead weight, and is much heavier than the top portion, which is hollow with the exception of the bottle keeper. Because the bottom portion is weighted, it will remain on the bottom and a bottle in the holder will remain upright. A flat portion on the bottom portion provides a place for the holder to rest. Because of the weight differential between the bottom and top portions, no matter how the bottle holder is set down, it will rock back to an upright position such that it will rest on the flat portion of the bottom portion.

Accordingly, it is a principal object of the invention to provide a bottle holder that will hold a bottle in an upright position.

It is another object of the invention to provide a holder in which a bottle is held during use.

It is a further object of the invention to provide a bottle holder that will roll to an upright position regardless of the position in which the holder and the bottle are placed.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
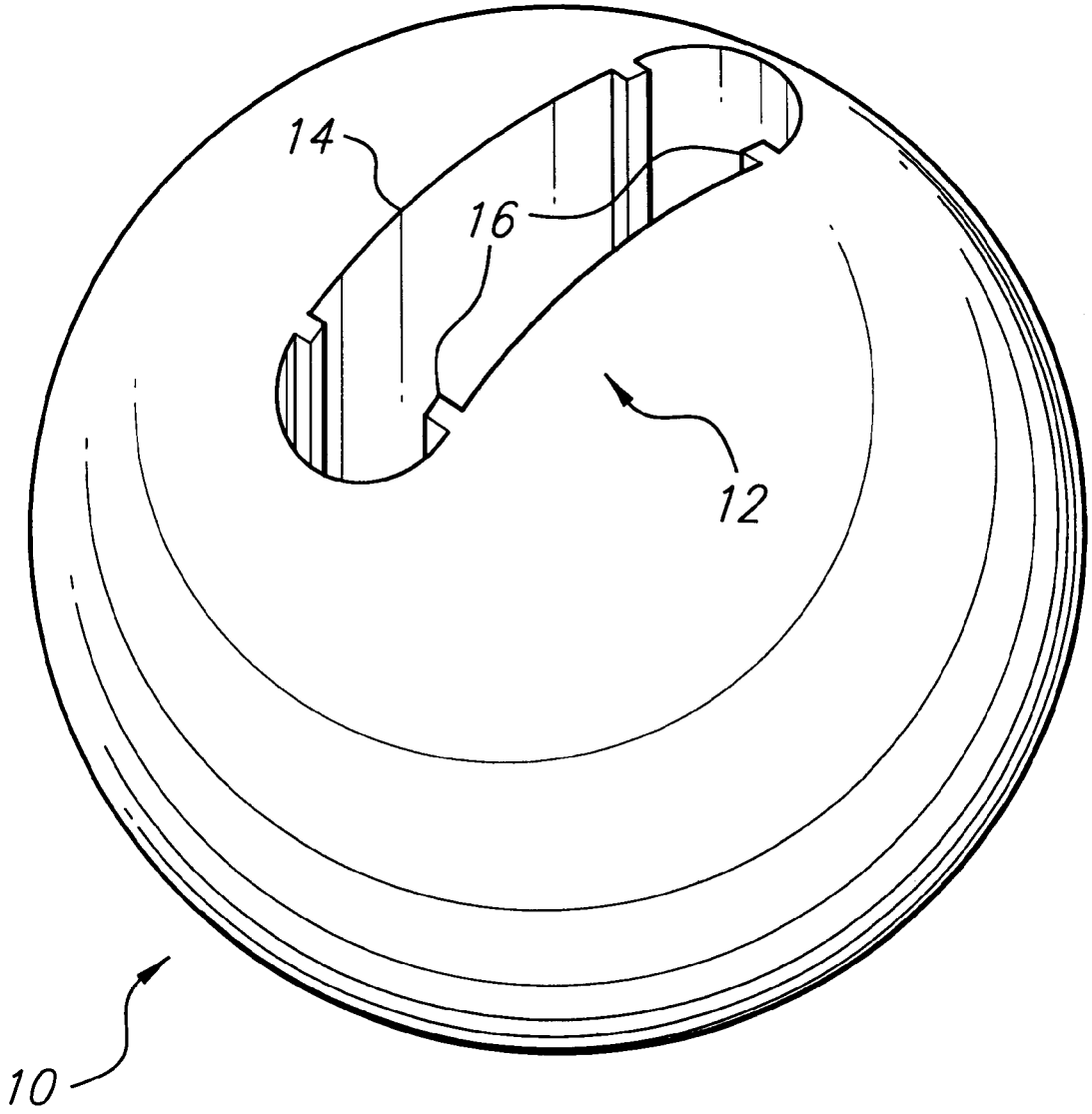
FIG. 1 is an environmental, perspective view of a spill-proof holder according to the present invention.
Figure 1A:
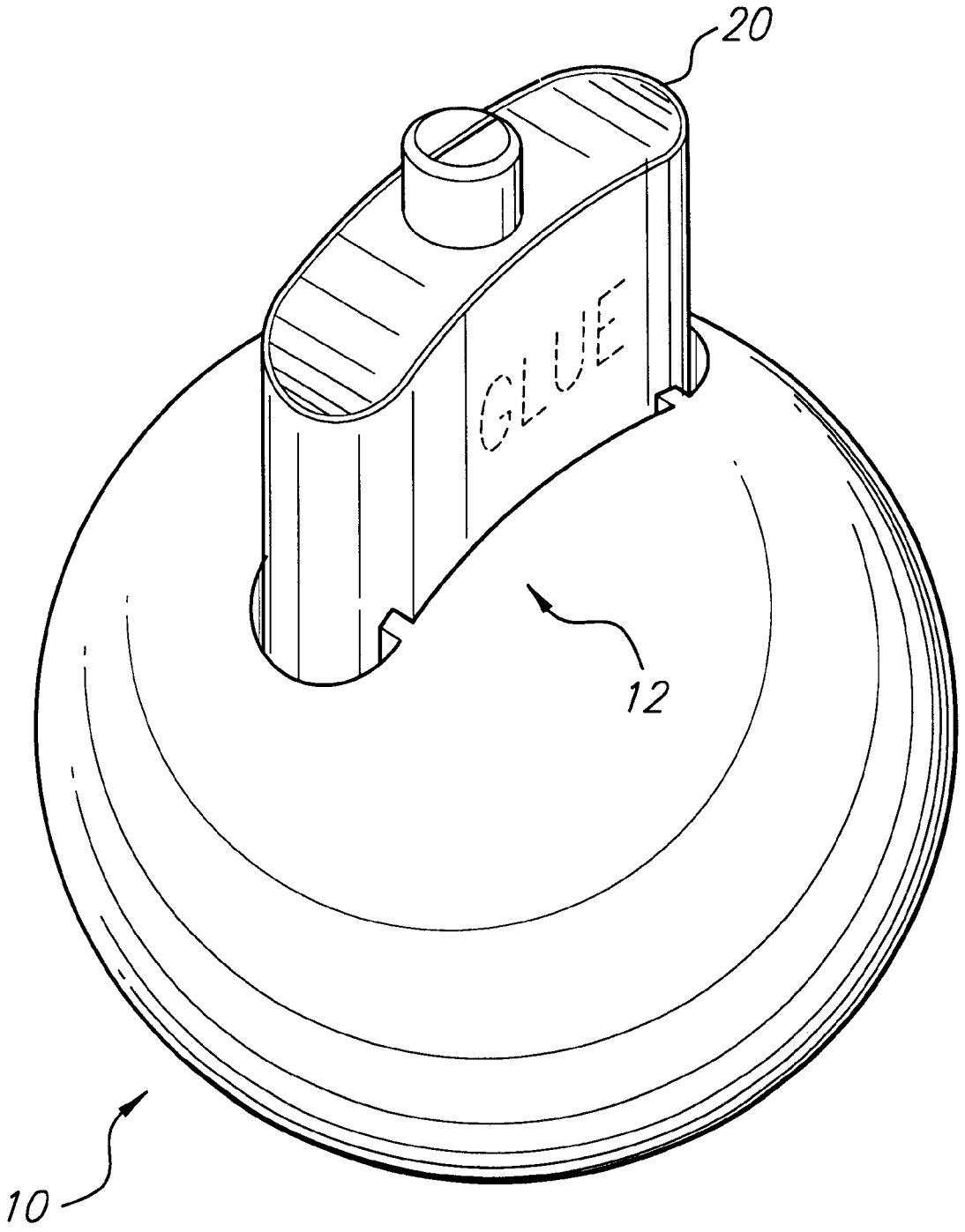
FIG. 1A is an environmental, perspective view of a spill-proof holder holding a bottle.
Figure 3:
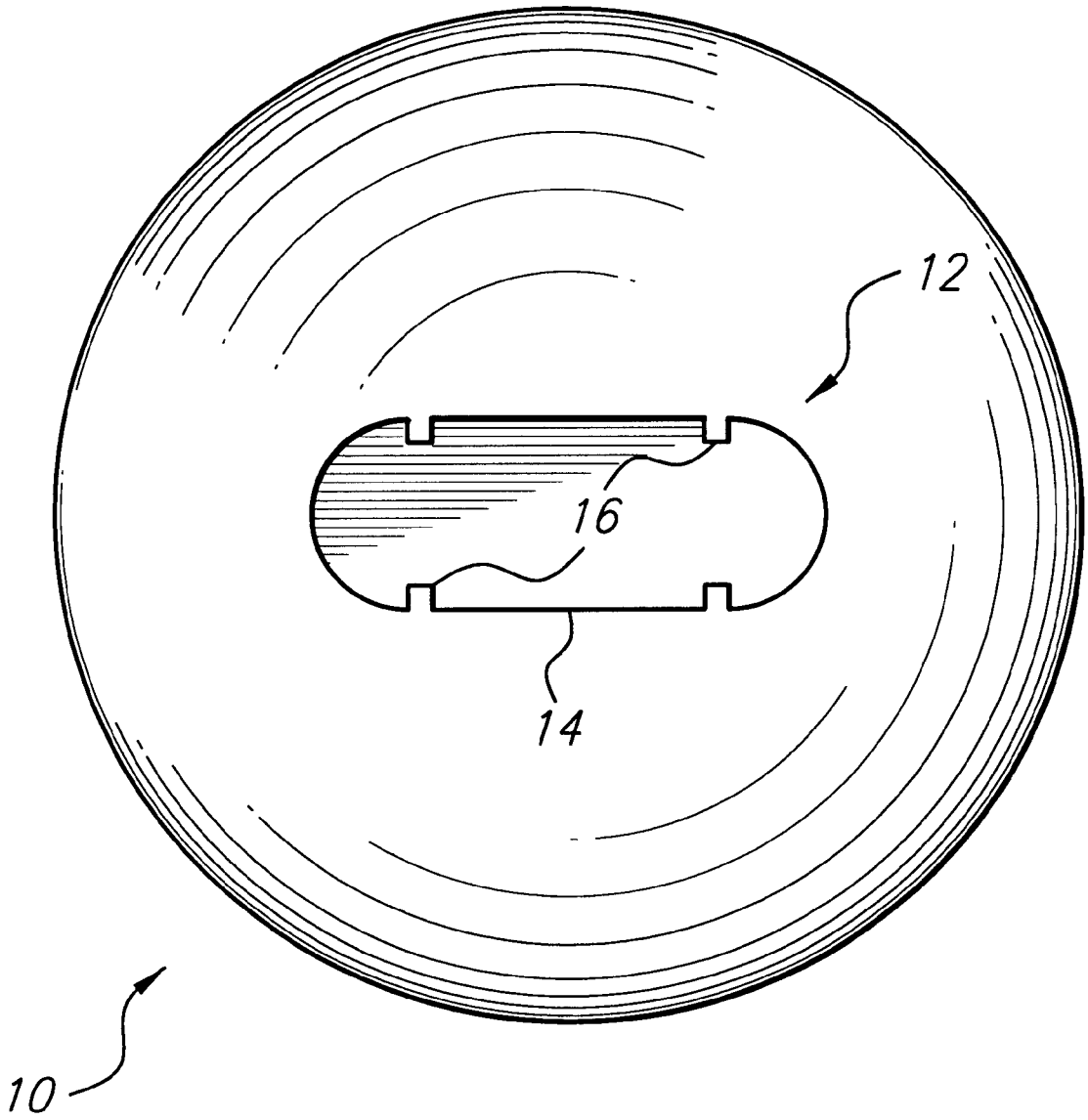
FIG. 3 is top plan view of the holder.

The present invention, as seen in overview in FIGS. 1 and 1A and in top view FIG. 3, is a bottle holder 10 for holding a bottle, e.g. a bottle of glue 20, in an upright position. It is also recognized that the holder can be used to hold a bottle of nail polish, liquid medications (eardrops or eyedrops), industrial solvents, or any other bottled liquid. A common use is in the hobby industry for "CA" glues.

The bottle holder 10 is preferably made out of plastic; however, it is noted that other materials may prove to be acceptable for the intended purpose. Regardless of the position in which the holder is placed, it will roll itself into an upright position (this feature is discussed in more detail below). The upper surface of the holder 10 has a bottle keeper 12 for holding the bottle. The keeper 12 is shown as oval. However, it is noted that it can be circular or square or any other shape to fit the desired type of bottle. The keeper 12 includes a sidewall 14, sizing bars 16 molded into the sidewall 14, and a floor 18 (FIG. 2).

The sizing bars 16 hold the bottle in place in the bottle keeper 12. The sizing bars fit snugly around a bottle 20, allowing one to use the bottle without removing it from the holder 10. Because the bottle will conform to the sizing bars, bottles of slightly different sizes can be used and held in place with the same holder 10. It is noted that any practical number of sizing bars 16 can be used in and are contemplated by the instant invention.

Figure 2:
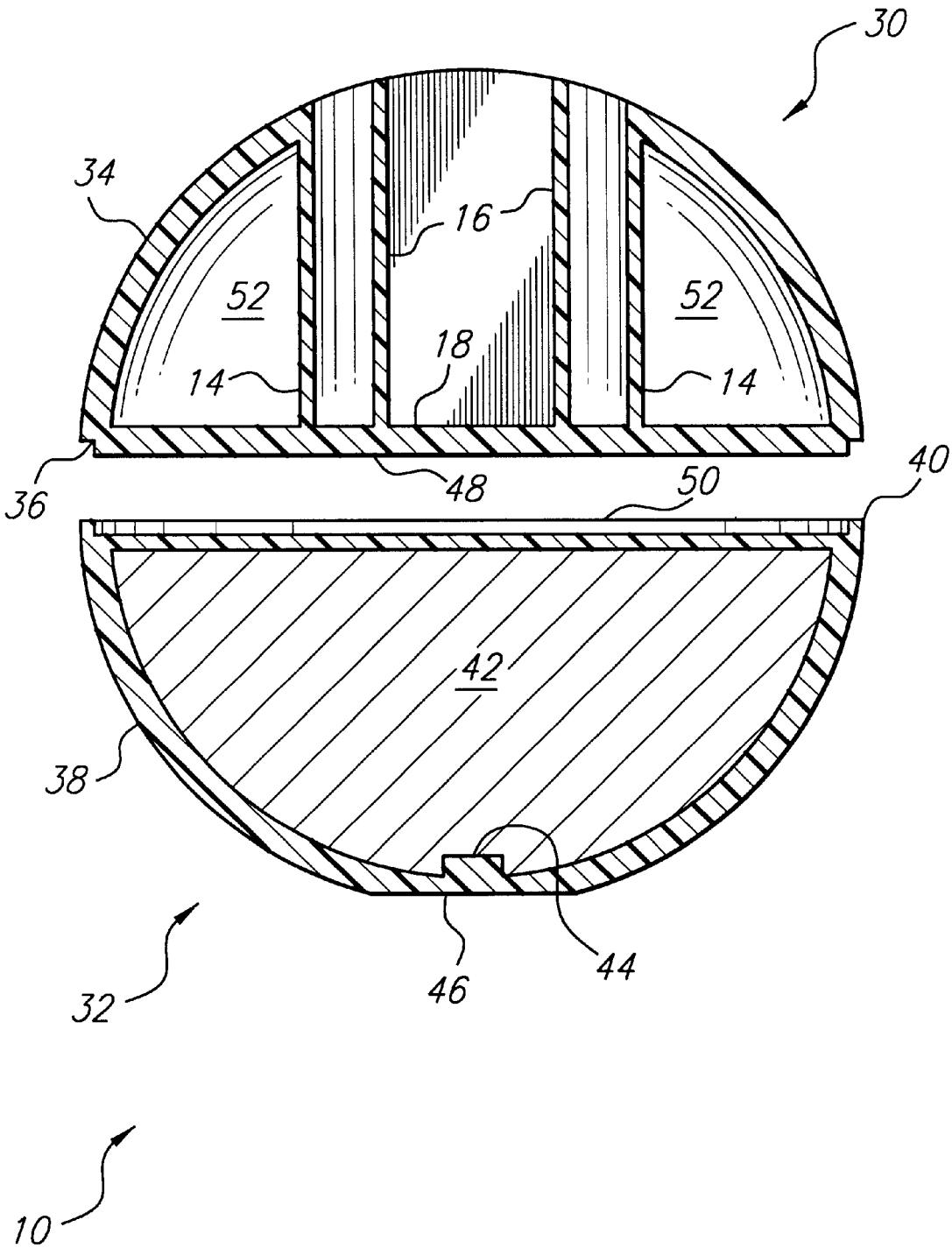
FIG. 2 is a front, cross-sectional, exploded view of the holder.

Other details of the bottle holder 10 can be seen in FIG. 2. The bottle holder 10 can be made of a top portion 30 and a bottom portion 32. The top portion 30 includes a rounded surface 34 and a flat surface 36, and the bottom portion 32 includes a rounded surface 38 and a flat surface 40. The bottom portion 32 includes a weight 42, which is held in place and mated to a notch 44.

Because the bottom portion 32 is weighted, it will remain on the bottom and a bottle 20 in the holder 10 will remain upright. A flat portion 46 on the rounded surface 38 of the bottom portion 32 provides a place for the holder 10 to rest and maintain the bottle 20 in an upright position.

The top and bottom portions 30 and 32 may be attached by mating a male flange 48 and a female receptacle 50. The portions 30 and 32 may be secured together by adhesive, sonic welded, or any other known method.

The top portion 30 includes hollow areas 52 and is completely hollow with the exception of the bottle keeper 12. These hollow areas 52 make the top portion 30 even lighter relative to the bottom portion 32 and insure that no matter how the bottle holder is set down, it will rock back to an upright position such that it will rest on the flat portion 46 of the bottom portion 32.

It is to be understood that the present invention is not limited to the embodiment described above, but encompasses any and all embodiments within the scope of the following claims.

I claim:

1. A bottle holder comprising:

a hemispherical top portion having a rounded surface and a flat surface, and including a bottle keeper defined in said rounded surface, said bottle keeper having a sidewall extending from said rounded surface toward said flat surface, a floor at the termination of said sidewall near said flat surface, and a plurality of sizing bars in said sidewall;

a hemispherical bottom portion having a generally rounded surface and a flat surface, and including a weight such that said bottom portion has a greater weight than said top portion; and a first mating means on said flat surface of said top portion and a second mating means on said flat surface of said bottom portion such that the attachment of said top portion and said bottom portion result in a bottle holder which is spherical;

whereby said bottle holder will roll to a position where said round surface of said top portion and a bottle in said bottle holder is upright.

2. The bottle holder of claim 1 wherein said generally rounded surface of said bottom portion includes a flat portion centered about said generally rounded surface of said bottom portion such that said bottle holder will rest or roll to rest on said flat portion.

3. The bottle holder of claim 1 wherein said bottom portion includes a protrusion extending internally from said rounded surface of said bottom portion towards said flat portion of said bottom portion for mating with and holding said weight in place.

4. The bottle holder of claim 1 wherein said first mating means is a protruding ledge extending from said flat surface of said top portion and said second mating means is a receptacle defined by said bottom portion.

5. The bottle holder of claim 1 wherein said top portion is hollow and includes only said bottle keeper.

* * * * *